United States Patent [19]

Rouby et al.

[11] 4,255,186

[45] Mar. 10, 1981

[54] IRON-CONTAINING ALLOYS RESISTANT TO SEAWATER CORROSION

[75] Inventors: Michel Rouby; Jean-Paul Eymery, both of Imphy, France

[73] Assignee: Creusot-Loire, Paris, France

[21] Appl. No.: 2,748

[22] Filed: Jan. 11, 1979

[30] Foreign Application Priority Data

Jan. 19, 1978 [FR] France ..... 78 01452

[51] Int. Cl.[3] ..... C22C 30/00

[52] U.S. Cl. ..... 75/122; 75/134 F

[58] Field of Search ..... 75/122, 134 F, 171

[56] References Cited

U.S. PATENT DOCUMENTS

| | | | |
|---|---|---|---|
| 3,127,265 | 3/1964 | Avery et al. | 75/176 |
| 3,183,084 | 5/1965 | Heydt et al. | 75/134 F |
| 3,420,660 | 1/1969 | Kawahata et al. | 75/122 |
| 3,705,827 | 12/1972 | Muzyha et al. | 75/122 |

*Primary Examiner*—R. Dean

*Attorney, Agent, or Firm*—Haseltine and Lake

[57] ABSTRACT

Iron-base alloys having a high elastic limit after quenching and ageing and resistant to corrosion by seawater, have the following composition, by weight:

| | |
|---|---|
| C | less than 0.15% |
| Mn | less than 2% |
| Si | less than 1.5% |
| S + P | less than 0.03% |
| Ni | 34-40% |
| Cr | 16-21% |
| Co | 6-18% |
| Mo | 2-3.5% |
| Al | less than 0.25% |
| Ti | 2.5-3.5% |
| W | less than 2% |
| B | less than 0.015% |
| Fe | balance |

9 Claims, No Drawings

IRON-CONTAINING ALLOYS RESISTANT TO SEAWATER CORROSION

BACKGROUND OF THE INVENTION (a) Field of the Invention

The present invention relates to iron-base alloys which have a high elastic limit after appropriate thermal treatment and are resistant to corrosion by seawater, marine sludge, salt spray and brackish waters.

(b) Prior Art

For the manufacture of certain articles intended to be used for long periods in an underwater environment, for example articles forming part of submarine teletransmission cables, it is necessary to use stainless steels or alloys which are extremely resistant to corrosion by seawater and the sludge deposited on the sea-bed on which the cable rests.

Certain parts of such submarine cables are subjected, while they are being laid on the sea bottom or while they are being brought up for checking or maintenance work, to extremely large stresses which depend on the depth of immersion and on the condition of the sea at the time when the cable is laid or lifted. One kind of cable part which is liable to be subjected to such stresses is the underwater repeater which may need to be lifted several years after it has been laid. Although the seawater-resistant stainless steels which are conventionally employed for such purposes are resistant to corrosion during long periods of immersion, they have an inadequate elastic limit for the parts to be able to withstand the considerable stress which can be caused by lifting operations after immersion for several years.

No alloys are at present known which resist corrosion by seawater and marine sludge as satisfactorily as stainless steels, such as the steel marketed under the trademark URANUS 50 by Creusot-Loire, and which, at the same time, have a high elastic limit after quenching and ageing treatment, for example an elastic limit of more than 600 Newtons/mm$^2$.

OBJECT OF THE INVENTION

An object of the present invention is, therefore, to provide alloys which have a high elastic limit after quenching and ageing treatment and which resist corrosion by seawater during long periods of immersion on the sea-bed, so that immersed parts made of such alloys retain their good mechanical characteristics during such long periods of immersion.

SUMMARY OF THE INVENTION

According to the present invention, there are provided iron-base alloys which have a high elastic limit after quenching and ageing and are resistant to corrosion by seawater, said alloys consisting essentially of, by weight, less than 0.15% of carbon, less than 2% of manganese, less than 1.5% of silicon, less than 0.03% of sulphur and phosphorus, from 34 to 40% of nickel, from 16 to 21% of chromium, from 6 to 18% of cobalt, from 2 to 3.5% of molybdenum, less than 0.25% of aluminium, from 2.5 to 3.5% of titanium, less than 2% of tungsten, and less than 0.015% of boron, the balance being iron and unavoidable impurities.

In order to obtain optimum mechanical characteristics in the alloys according to the invention, they are subjected to the following treatments:

(i) solution treatment at 950°-1050° C. for about 1 hour, (ii) quenching in oil or water, (iii) ageing at 800°-850° C. for 15 to 25 hours, (iv) cooling in air to 700°-750° C., (v) ageing at 700°-750° C. for 15 to 25 hours, and (vi) cooling in air to ambient temperature.

DETAILED DESCRIPTION OF THE INVENTION AND SPECIFIC EXAMPLES

Preferred alloys according to the invention suitable for the manufacture of parts which must be resistant to corrosion in a marine environment for long periods of immersion at great depth, will now be described, by way of example, for the better understanding of the invention.

EXAMPLES

Castings of five alloys according to the invention were produced in a vacuum furnace and were used to make anchoring parts for repeaters for submarine telephone cables. The composition of the alloys, in percentages by weight, is shown in Table I, the balance in each case being iron.

TABLE I

| REFERENCE | C | Mn | Si | S | P | Ni | Cr | Mo | Co | Ti | Al | W | B |
|---|---|---|---|---|---|---|---|---|---|---|---|---|---|
| A | 0.075 | 0.13 | 0.21 | 0.006 | 0.008 | 34.74 | 17.44 | 2.25 | 10.07 | 2.58 | 0.12 | 0.92 | 0.0066 |
| B | 0.059 | 0.10 | 0.22 | 0.006 | 0.008 | 34.62 | 17.40 | 2.25 | 10.08 | 2.71 | 0.06 | 0.92 | 0.0066 |
| C | 0.047 | 0.50 | 0.32 | 0.006 | 0.005 | 36.92 | 18.24 | 2.99 | 16.03 | 2.81 | 0.22 | 0.60 | 0.0050 |
| D | 0.048 | 0.62 | 0.20 | 0.006 | 0.010 | 37.84 | 18.58 | 3.06 | 15.50 | 2.81 | 0.25 | 0.75 | 0.0056 |
| E | 0.065 | 0.45 | 0.23 | 0.004 | 0.011 | 35.43 | 17.95 | 2.80 | 11.20 | 2.75 | 0.15 | 0.01 | 0.0052 |

Part of the metal was used to make samples for mechanical tests and another part for producing the anchoring parts which were used for laboratory tests for corrosion by a chlorine-containing medium and for corrosion tests on immersion in seawater.

Similar parts, (a) made of conventional stainless steel of the 316 L type containing 0.02% of carbon, 17% of chromium and 12% of nickel, balance iron, (b) made of URANUS 50 stainless steel containing 0.03% of carbon, 21% of chromium and 7% of nickel, balance iron, and (c) made of an alloy of iron, nickel and chromium, containing 25% of nickel, were also produced. These parts were subjected to the same corrosion tests in seawater as the parts made of alloys according to the invention.

The castings produced in the vacuum furnace were subjected to a heat treatment consisting of a superquenching treatment and an ageing treatment in several stages. The whole treatment comprised a homogenization treatment at 990° for one hour, quenching in oil, ageing at 815° for 20 hours, cooling in air, ageing at 730° for 20 hours, and then cooling in air to ambient temperature.

The alloys produced had an austenitic structure and contained $\gamma'$-phase precipitates having the composition $Ni_3TiAl$, and carbides after the heat treatment described above. The alloys according to the invention are non-magnetic.

Table II shows the results of mechanical tests carried out on the samples which were produced and heat-treated as described above.

TABLE II

| $E_{0.2}$ N/mm² | R N/mm² | A % 5d | KCU daj/cm² |
|---|---|---|---|
| 852 | 1215 | 26.8 | 6.6 |
| 893 | 1234 | 27.6 | 5.4 |
| 810 | 1153 | 22.4 | 4.0 |
| 892 | 1138 | 28.0 | 4.3 |
| 840 | 1188 | 29.2 | 4.7 |
| 770 | 1195 | 28.8 | 5.7 |
| 750 | 1206 | 28.4 | 8.1 |

It is seen that the elastic limit of these samples was high and in all cases was greater than 750 Newtons/mm², while the tensile strength of the samples was greater than 1150 Newtons/mm².

If the proportions of alloying elements are as defined above and if the heat treatment used is as described, it is possible to guarantee in all cases an elastic limit of more than 600 Newtons per mm² and a tensile strength of more than 1000 Newtons/mm².

It is seen, in addition, that the alloy retains an adequate ductility and a good resilience after heat treatment.

Furthermore, anchoring parts made from the alloys according to the invention by rolling followed by heat treatment as above described, and also parts made from known alloys (a), (b) and (c) referred to above, were subjected to prolonged corrosion tests in the laboratory in a chlorine-containing medium and also to tests involving direct immersion in the sea for a period of 30 months.

All the parts made from alloys according to the invention appeared to have suffered no corrosion, both in the laboratory tests in a chlorine-containing medium and in the tests involving immersion in seawater. The laboratory tests showed an excellent resistance of these alloys to stress-corrosion tests and the samples did not show any trace of corrosion as evidenced by pitting or by cracking.

The samples produced from URANUS 50 stainless steel were also very resistant overall, except in one case where corrosion was observed. Finally, the samples made of 316 L stainless steel (known alloy (b) above) and of an alloy containing 25% of nickel (known alloy (c) above) showed a substantial amount of corrosion as evidenced by cracking.

It is therefore seen that after a heat ageing treatment, the alloys according to the invention not only have mechanical properties which are superior to those of known stainless steels which are resistant to corrosion by seawater, but also a corrosion resistance which is itself superior to that of the stainless steels of the URANUS 50 type, containing 21% of chromium and 7% of nickel.

It should be noted that among the various alloying elements listed, some of them, such as tungsten, are not obligatory and that alloys which do not contain tungsten have the required properties. However, alloys according to the invention preferably contain from 0.5 to 2% of tungsten, this element contributing, together with molybdenum, to the hardening of the alloy as a solid solution.

While cobalt may be present in an amount up to 18%, it is preferred that it should be present in a proportion of from 6 to 11%. An additional advantage of the presence of a small amount of cobalt is that the cost of the alloy is thereby reduced.

Preferred proportions of less than 0.08% of carbon and less than 1% of manganese are recommended for the production of the alloys according to the invention; however, the desired characteristics are obtained when the proportions of these elements are below the limits recommended above (0.15% and 2% respectively).

The alloys according to the invention can be used, not only for the manufacture of parts intended for connecting submarine cables which must possess a very high resistance to corrosion by seawater during prolonged immersion and a high elastic limit making it possible for them to withstand high stresses during the lifting of the cable, but also for the manufacture of any parts which are intended to be used in seawater and must withstand high stresses.

The alloys can therefore be used in the field of underwater construction and more particularly for the manufacture of periscope tube parts. Furthermore, the fact that they are non-magnetic, means that they are very suitable for this kind of application.

The alloys according to the invention can also be used in all cases where a very high corrosion resistance in a chlorine-containing medium is required.

What is claimed is:

1. Iron-containing alloys which have an elastic limit higher than 600 Newtons per mm² after quenching and ageing and are resistant to corrosion by seawater, for at least 30 months, said alloys consisting essentially of, by weight, less than 0.15% of carbon, less than 2% of manganese, less than 1.5% of silicon, less than 0.03% of sulphur and phosphorus, from 34 to 40% of nickel, from 16 to 21% of chromium, from 6 to 18% of cobalt, from 2 to 3.5% of molybdenum, less than 0.25% of aluminum, from 2.5 to 3.5% of titanium, less than 2% of tungsten, and less than 0.015% of boron, the balance being iron and unavoidable impurities.

2. Iron-containing alloys as set forth in claim 1, which consist essentially of, by weight, less than 0.08% of carbon, less than 1% of manganese, less than 1.5% of silicon, less than 0.03% of sulphur and phosphorus, from 34 to 40% of nickel, from 16 to 21% of chromium, from 6 to 11% of cobalt, from 2 to 3.5% of molybdenum, less than 0.25% of aluminum, from 2.5 to 3.5% of titanium, from 0.5 to 2% of tungsten, and less than 0.015% of boron, the balance being iron and unavoidable impurities.

3. A fabricated article for use in seawater, said article being formed of an iron-containing alloy as set forth in claim 1.

4. Iron-containing alloys as set forth in claim 1 consisting essentially of 0.048–0.075 carbon
0.10–0.62 manganese
0.20–0.32 silicon
0.004–0.006 sulphur
0.005–0.011 phosphorous
34.62–37.84 nickel
17.40–18.58 chromium
2.25–3.06 molybdenum
10.07–16.03 cobalt
2.58–2.81 titanium
0.06–0.25 aluminum
0.01–0.92 tungsten
0.0050–0.0066 boron the balance being iron and unavoidable impurities.

5. Iron-containing alloys as set forth in claim 1 consisting essentially of
0.075 carbon
0.13 manganese
0.21 silicon
0.006 sulphur
0.008 phosphorous
34.74 nickel
17.44 chromium
2.25 molybdenum
10.07 cobalt
2.58 titanium
0.12 aluminum
0.92 tungsten
0.0066 boron
the balance being iron and unavoidable impurities.

6. Iron-containing alloys as set forth in claim 1 consisting essentially of
0.059 carbon
0.10 manganese
0.22 silicon
0.006 sulphur
0.008 phosphorous
34.62 nickel
17.40 chromium
2.25 molybdenum
10.08 cobalt
2.71 titanium
0.06 aluminum
0.92 tungsten
0.0066 boron
the balance being iron and unavoidable impurities.

7. Iron-containing alloys as set forth in claim 1 consisting essentially of
0.047 carbon
0.50 manganese
0.32 silicon
0.006 sulphur
0.0005 phosphorous
36.92 nickel
18.24 chromium
2.99 molybdenum
16.03 cobalt
2.81 titanium
0.22 aluminum
0.60 tungsten
0.0050 boron
the balance being iron and unavoidable impurities.

8. Iron-containing slloys as set forth in claim 1 consisting essentially of
0.048 carbon
0.62 manganese
0.20 silicon
0.006 sulphur
0.010 phosphorous
37.84 nickel
18.58 chromium
3.06 molybdenum
15.50 cobalt
2.81 titanium
0.25 aluminum
0.75 tungsten
0.0056 boron
the balance being iron and unavoidable impurities.

9. Iron-containing alloys as set forth in claim 1 consisting essentially of
0.065 carbon
0.45 manganese
0.23 silicon
0.004 sulphur
0.011 phosphorous
35.43 nickel
17.95 chromium
2.80 molybdenum
11.20 cobalt
2.75 titanium
0.15 aluminum
0.01 tungsten
0.0052 boron
the balance being iron and unavoidable impurities.

* * * * *